United States Patent [19]

Albin et al.

[11] 3,971,164

[45] July 27, 1976

[54] BOWLING BALL RESURFACING MACHINE

[76] Inventors: Merritt Timothy Albin, 6337 Bluebell Ave., North Hollywood, Calif. 91606; James W. Benton, 3650 Mountain View Ave., Pasadena, Calif. 91109

[22] Filed: May 27, 1975

[21] Appl. No.: 580,576

[52] U.S. Cl. ..... 51/129; 51/236; 51/273

[51] Int. Cl.[2] ..... B24B 11/06; B24B 55/06

[58] Field of Search ..... 51/102, 103, 129, 131, 51/289 S, 103 R, 273, 236, 123 R, 125, 128; 90/12, 20; 15/21 A; 408/DIG. 1; 308/189

[56] References Cited

UNITED STATES PATENTS

| | | | |
|---|---|---|---|
| 3,157,009 | 11/1964 | Barkley | 51/273 |
| 3,179,013 | 4/1965 | Goldsmith | 90/20 |
| 3,863,397 | 2/1975 | Reitz | 51/131 |

*Primary Examiner*—Al Lawrence Smith
*Assistant Examiner*—Nicholas P. Godici
*Attorney, Agent, or Firm*—Lawrence Fleming

[57] ABSTRACT

A machine for removing excess filling material and refinishing the surface to a true sphere after one or more of the finger holes in a bowling ball have been filled in. The machine frame carries a motor-driven sanding disc and a pair of ways. Slidable on the ways is a carriage, which may be moved by means of a lead screw rotated by a hand wheel with a calibrated dial. The bowling ball to be refinished is supported rollably on a number of ball casters or the like which are mounted on the carriage. The ball may be rotated or rolled by hand about any axis, but is constrained against motion in translation except by translation of the carriage itself. In use, the carriage is advanced until the ball just touches tangentially the rotating sanding disc. The ball is then rolled manually to present its surface to the disc. The carriage may then be advanced 0.05 mm or so and the process repeated. Dust from the operation is collected in a novel housing by a combination of centrifugal and suction means.

4 Claims, 3 Drawing Figures

BOWLING BALL RESURFACING MACHINE

BACKGROUND OF THE INVENTION

Bowling balls have gripping holes and balance holes, some of which may often require relocation. The old holes are plugged or filled with epoxy resin or other plastic material. The excess filling material protrudes and must be machined down even with the spherical surface of the ball. A prior machine for this purpose is shown for example in U.S Pat. No. 3,106,133 to J. Arpanio, Jr. et al, and employs a router mounted in a bell jar. There is a need for an improved machine capable of greater precision, faster operation, and better visibility of the work.

BRIEF SUMMARY

This invention is a machine tool for machining or grinding the surfaces of spherical workpieces, such as bowling balls, particularly those portions where a repair or modification has created a bulge. Such a bulge occurs when a hole in a bowling ball has been filled in with epoxy or other plastic material; it is then necessary to remachine the surface to a true sphere.

The machine of the invention comprises a frame, a slidable carriage, a rollable work support for the spherical workpiece on the carriage, and a rotating cutting tool whose cutting elements lie substantially in a plane. A preferred form of tool is a sanding disc. The bearings in which its shaft rotates are fixed to the frame of the machine.

The rollable work support preferably takes the form of a plurality of ball casters or the like, fixed to the carriage. The workpiece may be laid on the casters and supported thereby so that it may be rotated freely by hand about any axix—but is constrained against translatory motion in any direction. With a bowling ball so supported, the carriage may be moved toward the sanding disc until the ball just touches the surface of the disc, tangentially. The carriage is on ways which are fixed to the machine frame, and its motion is preferably controlled by a lead screw in known manner. The lead screw is preferably equipped with a dial, similarly to the cross-slide in a lathe.

The sanding disc may then be rotated by a motor, and the ball rotated manually this way and that so that the abrasive disc machines the desired portion of its surface to a true spherical shape. This surface portion may have an irregular protuberance or bulge from a filled hole. It is found convenient in practice to then advance the carriage about 0.05 mm (0.002 inch) farther toward the abrasive disc and refinish the whole surface of the ball.

In machines of this kind, it is necessary to provide means to remove the particles cut or ground from the workpiece. This dust has been removed in the prior art by providing a transparent enclosure around the pertinent segment of the workpiece and the entire cutting tool, and then applying suction on the enclosure as by means of a vacuum cleaner. In such prior devices, dust or swarf tends to obscure the view through the enclosure. In the present invention, the sanding disc is enclosed in a shroud of generally spiral shape, whose outlet leads to a suction line; and the face portion of the shroud is cut away to admit the portion or segment of the ball to be machined, fitting around it fairly closely. A protruding lip surrounds the lower rim part of the cutaway portion of the shroud and extends close to the surface of the ball to intercept the dust. The bowling ball is freely accessible to, and manipulatable by, the operator during machining. The rotating sanding disc acts in the manner of the rotor of a centrifugal blower, and so assists the suction device in drawing the dust into the shroud.

DETAILED DESCRIPTION

Figure 1:
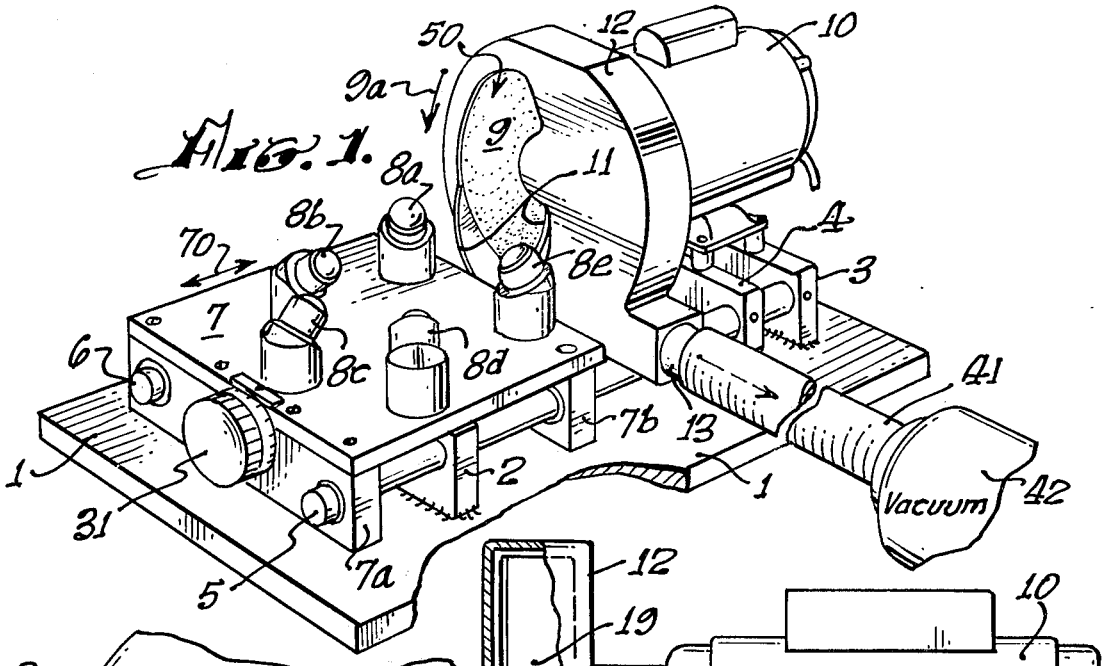
FIG. 1 is an isometric view of a machine according to the invention with the workpiece absent.

Referring to FIG. 1, a preferred machine according to the invention has a base 1, on which are mounted a motor 10 and a set of ways 5, 6. A carriage 7 is slidable on the ways. A plurality of ball casters or the like **8*a*–8*e* are mounted on the carriage 7. The bowling ball workpiece is not shown in FIG. 1, but is shown at 20 in FIGS. 2 and 3**.

The motor 10, which may be an ordinary ⅓-horsepower, 1725-rpm induction motor, rotates a sanding disc 9 which is mounted on a suitable fitting 19 attached to the shaft of the motor. The disc 9 is enclosed by a shroud 12, except for an opening 50 in its outer flat face (FIG. 1) which is provided to permit the ball workpiece to contact the standing disc 9. The point of contact is indicated at 40 in FIG. 2.

Figure 2:
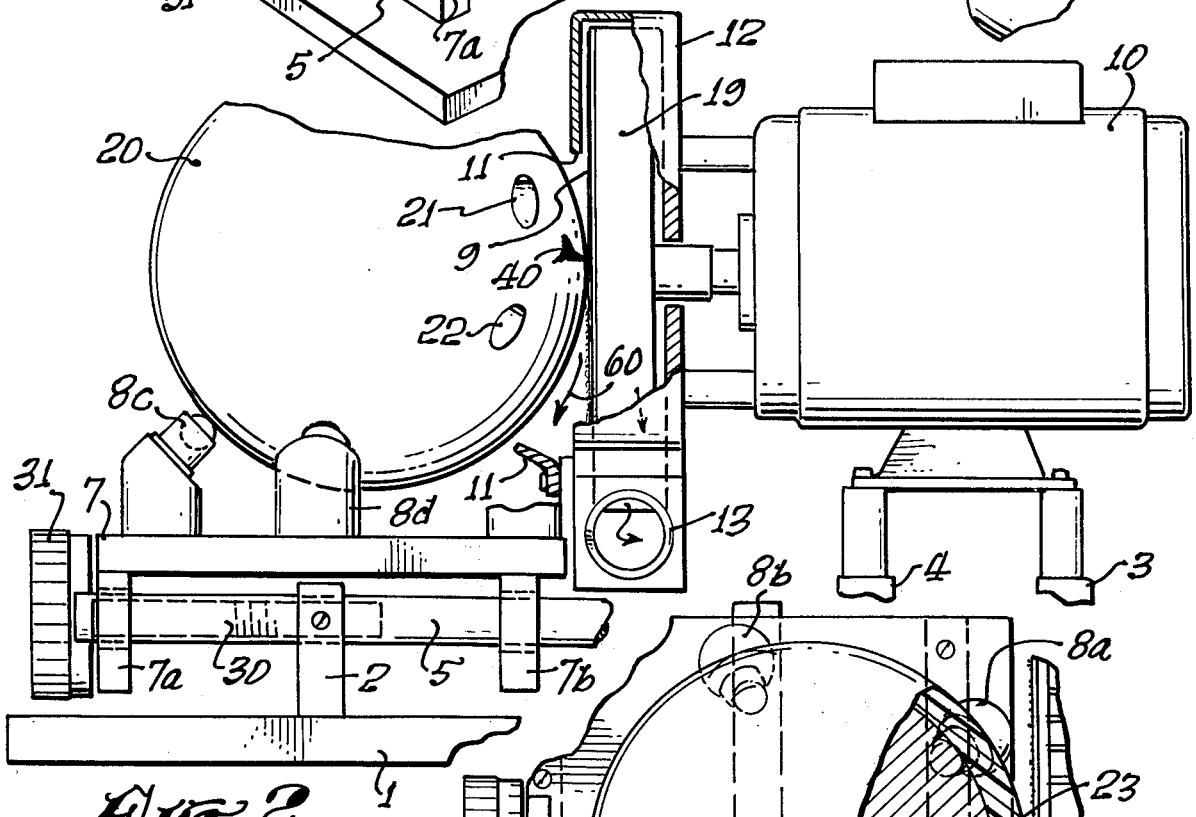
FIG. 2 is a partial side view, partly in section showing a workpiece in place.

Two holes 21, 22 in the ball 20 are shown in FIG. 2. These may be, for example, gripping holes. A filled hole 23 is shown in section in the top view of FIG. 3. A portion of the filling resin protrudes above the surface of the ball 20 at **23*a*. To sand or machine this material down even with the surface of the ball, the carriage 7 is advanced until the ball's surface is tangent to the surface of the sanding disc 9, and the ball is then rotated manually this way and that on the ball casters 8*a*–8*e*** until the desired portions of its surface have been finished to a true sphere.

The carriage 7 is moved in translation by means of a lead screw 30, FIG. 2, which is preferably fitted with a calibrated knob 31. The knob or dial 31 is preferably graduated in units of 0.001 inch or 0.01 millimeter. It is often desirable, after the excess protruding filling material **23*a*, FIG. 3, has been approximately sanded off, to advance the carriage 7 by 0.002 inch (0.5 mm) or so, and then refinish the whole surface of the ball 20**.

The ball casters or the like **8*a*–8*e* permit the ball workpiece 20 to be rotated about any axis, but not to move in translation. Commercial ball casters have been found satisfactory, but any device may be used here which supports the ball 20** at at least three points and permits it to rotate, but not to translate.

Figure 3:
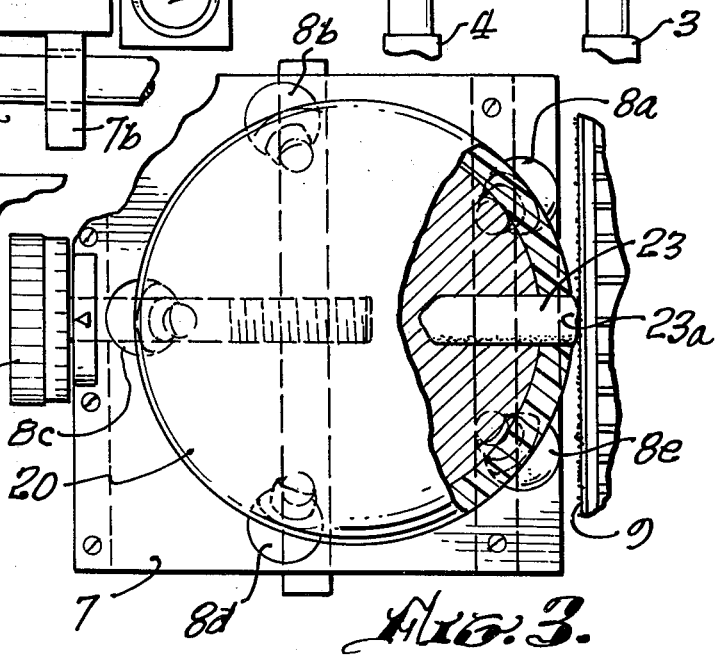
FIG. 3 is a partial top view, partly in section.

The machine illustrated here is a model fabricated mainly from metal rod and plate stock. Production models will employ suitably-designed castings, conventionally designed. In FIGS. 1–3, the ways 5, 6 are conveniently made of two parallel round bars, as shown. Three support plates 2, 3, 4 support the ways and are attached to the base 1. Two of the support plates 3, 4 also support the motor 10, FIGS. 1 and 2. The depending flange-like portions **7*a*, 7*b* of the carriage 7 are bored through and bushed, the rod-type ways 5, 6 passing through the bushed holes. The carriage is constrained to move only along the direction indicated by arrow 70, FIG. 1**.

A prime requirement in machinery of this general class is the removal of the dust or swarf produced by the sanding or like operation. The present invention provides novel means for this purpose. In FIGS. 1 and 2, the sanding disc or like tool is enclosed partly by a shroud 12, which is shaped generally like the spiral casing of a centrifugal blower. The disc 9 rotates counterclockwise as indicated by the arrow 9*a* in FIG. 1. An exit spout 13, FIGS. 1 and 2, is provided on shroud 12. To it is preferably connected a suction hose 41 leading to a vacuum cleaner or like suction device 42, FIG. 1.

The opening 50 in the shroud 12 is shaped to admit as much of the bowling ball workpiece 20 as is needed to permit tangential contact of its surface with the sanding disc 9, FIGS. 2 and 3. The intruding portion of the ball is approximately a segment of a sphere. This opening 50 is shaped so that it fits relatively closely—say with a clearance of a few mm or less—around the ball workpiece 20, as indicated in FIG. 2. In FIG. 2, the portion of sanding disc or the like 9 which is adjacent the surface of ball 20, as at 40, will be moving downward. See direction arrow 9*a* in FIG. 1. Accordingly, the material removed from the surface of ball 20 in the form of dust or swarf will move generally downward, as indicated by arrow 60, FIG. 2.

The invention provides for intercepting the dust by means of a shaped lip 11, FIGS. 1 and 2. This lip 11 may be made of sheet metal and attached to the lower portion of the front surface of the shroud 12, as indicated in FIGS. 1 and 2. The outer edge portion of lip 11 is shaped to conform to the adjacent surface of the bowling ball workpiece 20 with a suitable small clearance, such as a few mm. Exact illustration is difficult. The invention provides that the shape of the entire perimeter of the opening 50, FIG. 1, follow relatively closely the perimeter of the segment of ball 20 which intrudes into shroud 12 to contact sanding disc 9. The rotating disc 9 will drag air with it, producing some suction through the opening 50 and throwing air tangentially toward the outer perimeter of the shroud 12 and out through the exit spout portion 13, FIGS. 1 and 2, like the rotor in a centrifugal blower. This will effect some removal of the grinding dust or swarf out through the spout 13. To make the removal complete, a suction device, such as a shop-type vacuum cleaner 42, is connected to the spout 13 via a suitable hose 41, FIG. 1. I have found that the cooperation of the three elements, the shroud 12 with opening 50, the shaped lip 11, and the suction device 41, provides complete removal of the dust from the work, and at the same time provides for ready access to and manipulation of the ball workpiece 20.

It will be apparent that the sanding disc or like rotating element 9 may take other forms within the purview of the invention. Any rotating disc-like cutting or grinding tool may be employed, as a grinding wheel or a file-like toothed disc or cone; the machining element 9 need not be a flat disc so long as it engages the surface of the bowling ball workpiece 20 in a generally tangential fashion.

I claim:

1. A resurfacing machine for a bowling ball, comprising:

a frame;

ways on said frame;

a carriage slidable on said ways;

an abrasive disc and a shaft and motor means to rotate said disc mounted on said frame, the plane of said disc being perpendicular to the plane of said ways, and the diameter of said disc being substantial compared to the diameter of said bowling ball;

a plurality of ball-like rollable supports for said bowling ball mounted on said carriage and disposed around a circle in a plane parallel to said ways and permitting manual rotation of said ball about any axis but preventing its translation;

the center of said circle being displaced from the axis of said shaft in a plane parallel to said ways, the friction force of said disc acting to urge said bowling ball against said supports;

a shroud enclosing said disc;

an opening in said shroud for intrusion of a portion of said bowling ball and having a shape and a protruding dust-catching lip fitting closely around said portion on the trailing side;

a tangentially-disposed exit spout on said shroud; and external suction exhaust means connected to said spout to withdraw dust.

2. A machine as in claim 1, wherein:

said ways lie substantially horizontally, the plane of said abrasive disc being substantially vertical.

3. A machine as in claim 1, further comprising:

a lead screw disposed to displace said carriage along said ways, and a dial on said lead screw calibrated to permit such displacement in known increments of about 0.02 millimeters.

4. A machine as in claim 1, wherein said motor means rotates said disc at a speed lower than about 2000 revolutions per minute.

* * * * *